United States Patent [19]

Swarden et al.

[11] Patent Number: 4,986,479

[45] Date of Patent: Jan. 22, 1991

[54] FLUID JET SHREDDER APPARATUS AND METHOD OF USE

[75] Inventors: Michael C. Swarden, Cambridge; Henry B. Faulkner, Dover; Walter L. Brassert, Belmont, all of Mass.; James E. Stoudt, Stamford, Conn.

[73] Assignee: Ingersoll-Rand Company, Woodcliff Lake, N.J.

[21] Appl. No.: 393,898

[22] Filed: Aug. 14, 1989

[51] Int. Cl.[5] ..... B02C 19/06

[52] U.S. Cl. ..... 241/15; 241/29; 241/39; 241/42; 241/152 R

[58] Field of Search ..... 241/38, 39, 40, 41, 241/42, 44, 152 R, 15, 24, 29

[56] References Cited

U.S. PATENT DOCUMENTS 2,280,944 4/1942 Foresman ..... 241/40 X 4,602,743 7/1986 Nied ..... 241/39 X

*Primary Examiner*—Timothy V. Eley

*Attorney, Agent, or Firm*—James R. Bell

[57] ABSTRACT

A fluid jet shredder apparatus includes a conveyor for conveying a stream of material to be shredded. The conveyor has openings formed therein. A shredding station in position adjacent the conveyor and includes a fluid jet cutting nozzle directing a high pressure jet of fluid onto the stream of material. As a result, portions of the material are separated from the stream of material. The separated portions of material pass through the openings in the conveyor. A subsequent shredding station can be positioned downstream of the initial shredding station for directing a second and higher pressure jet of fluid onto the stream of material. The subsequent shredding station can therefore shred material which the initial, relatively lower pressure fluid jet failed to shred from the stream. Sequential shredding stations of incrementally increased pressure can progressively shred material of increased hardness from the stream. The fluid jets can selectively include an abrasive material.

14 Claims, 1 Drawing Sheet

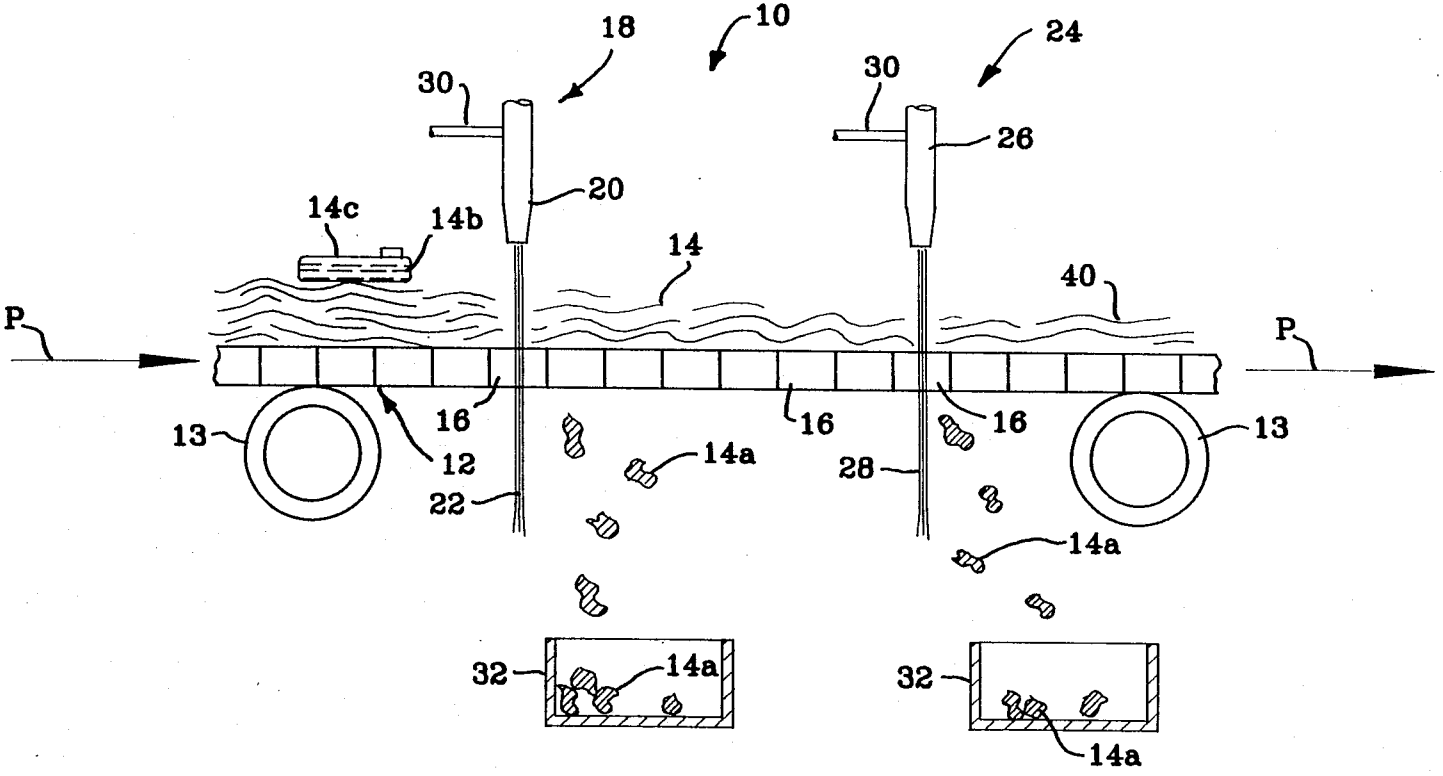
P
13
40
24
26
30
10
18
20
30
14
14b
14c
16
16
16
12
28
22
14a
14a
14a
32
32
13
P

FLUID JET SHREDDER APPARATUS AND METHOD OF USE

BACKGROUND OF THE INVENTION

This invention relates generally to cutting processes and more particularly to utilizing high-velocity jets of liquid or an abrasive laden liquid to shred solid material including metal.

An important application of large capacity shredding equipment is in processing solid waste streams. These streams contain mostly solid material, but may contain liquids, particularly in containers. In some cases the liquids may be volatile and flammable. Frequently the shredding operation is performed to process the waste stream for incineration.

Existing equipment for shredding a heterogeneous stream, containing solid material or mixed solid and liquid material, generally uses hardened and/or corrosion resistant steel cutting tools. During the shredding operation, sparks can be produced when the cutting tools strike hard objects. Therefore there is a fire hazard, and in the presence of volatile flammable liquids, an explosion hazard. These hazards can be overcome by immersing the shredding operation in water, but this requires that the stream first be dried if it is t be subsequently incinerated.

The metals used in the steel alloys of the cutting tools can be worn off in the shredding operation. If the stream is subsequently input into an incinerator to be incinerated, some of the metals can appear in the incinerator stack gas as air pollutant emissions. In some comparisons of emissions between incinerators which do and do not have shredding of the input stream, the emissions are generally comparable except for much higher emissions of beryllium, chromium, and nickel from those that had shredding of the input stream. These metals may also appear in the incinerator ash, making the ash more toxic.

The foregoing illustrates limitations known to exist in present devices. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a fluid jet shredder apparatus including means for conveying a stream of material to be shredded. The means for conveying has openings formed therein. A shredding station is positioned adjacent the means for conveying and includes a fluid jet cutting nozzle directing a high pressure jet of fluid onto the stream of material. As a result, portions of the material are separated from the stream of material. The separated portions of material pass through the openings in the conveying means.

The foregoing and other aspects will become apparent from the following detailed description of the invention when considered in conjunction with the accompanying drawing Figure. It is to be expressly understood, however, that the drawing Figure is not intended as a definition of the invention but is for the purpose of illustration only.

BRIEF DESCRIPTION OF THE DRAWING

In the drawing:

The Figure is a side view diagrammatically illustrating an embodiment of the fluid jet shredding apparatus of the present invention.

DETAILED DESCRIPTION

Referring to the drawing Figure, it can be seen that a fluid jet shredder apparatus is generally designated 10. Means such as a grate or perforated movable belt 12 is formed of a suitably hard material to resist fluid jet cutting. Belt 12 is supported by belt support means 13 and conveys a heterogeneous stream of material 14 along a path of travel indicated by directional arrows designated P. A plurality of openings 16 are formed in belt 12.

The material 14 may include mostly solid material, such as the metal portions designated **14*a*, but may contain liquids 14*b* in containers 14*c*. The liquids 14*b*** may be volatile and flammable.

A first shredding station 18 is adjacent belt 12 and includes a bank of well known fluid jet cutting nozzles 20, provided side-by-side. As a result, only one of the nozzles 20 is shown in side view, each directing a high pressure jet of fluid 22 onto material 14. Fluid 22 is selectively provided at a first pressure so as to separate relatively softer portions of material 14 from the stream. The separated material falls through openings 16 in belt 12 as indicated at **14*a***.

A second shredding station 24 also includes a bank of side-by-side, well known fluid jet cutting nozzles 26, only one of which is shown in side view directing a pressure jet of fluid 28 onto material 14. Fluid 28 is selectively provided at a second pressure, higher than the first pressure, so as to separate relatively harder portions of material 14 from the stream than the portions separated at first shredding station 18. Similarly, the separated harder material falls through the openings 16 in belt 12 as indicated at **14*a*. If desired, nozzles 20, 26 may be provided with an abrasive material fed to fluid 22, 28 via an inlet 30 connected to nozzles 20, 26** in a manner well known in fluid jet cutting to enhance cutting of harder materials.

Alternatively, additional banks of nozzles may be provided if desired and selected ones or all cutting stations may be provided with abrasive laden fluids. Of course, in some instances no abrasives may be required but only the progressively increased pressure of the fluid jets at the sequential cutting stations.

Means such as bins 32 may be provided at each shredding station and below belt 12 so as to receive the separated portions of material **14*a***.

The apparatus 10 operates by using the one or more high-velocity jets of fluid 22, 28, to shred solid material or to remove solid material below a certain hardness from the solid mass or solid stream of material 14. The fluid jet velocity and the concentration and type of abrasive in the fluid jet will determine the upper threshold of hardness of material 14 that is shredded or removed. One or more fluid jets of specific velocity and abrasive type and concentration are used to cut the softer solids into the small pieces **14*a* that may be separated from the harder solids. This system will also separate materials of different hardness that are closely attached or bonded to one another. By using sequential stations of jets, each station having increased jet velocity and/or abrasive concentration, solids may be classified into several hardness categories. Solid material 40, having a hardness too great to be cut by any of the jets, will maintain its integrity throughout the process and remain on belt 12** as indicated.

In an alternative embodiment, the stream could fall vertically past a set of horizontally directed fluid jets. Then the stream would be subsequently sorted by size to accomplish sorting by hardness. In this arrangement, a material having a hardness greater than the hardness of the belt could be shredded since the fluid jets would not be directed toward the belt. In this alternative embodiment as well as in the embodiment illustrated in the drawing, the stream of material is conveyed along a path of travel and the fluid jets are directed across the path. Material shredded is then small enough to fall through openings 16 and/or to be displaced from the path by the fluid jets, in each case moving to a location disposed outside the path. The shredded material can be removed to a location alongside or below the path, e.g., on an opposite side of the path from the fluid jet nozzles, as shown and described.

While this invention has been illustrated and described in accordance with a preferred embodiment, it is recognized that variations and changes may be made therein without departing from the invention as set forth in the claims.

What is claimed is:

1. A method for shredding, comprising the steps of:

conveying a stream of material along a path through a shredding station;

carrying the stream of material on a substantially horizontally movable member having openings therein;

directing a high pressure fluid jet on the stream of material in a direction crossing the path, whereupon portions of the material are shredded;

collecting the shredded portions of the material at a location outside the path; and receiving the shredded portions of the material that fall through the openings.

2. The method defined in claim 1, wherein the stream of material contains at least one of metal, volatile liquid and flammable liquid.

3. A method for shredding and sorting, comprising the steps of:

conveying a stream of material along a path through a first shredding station and a second shredding station;

directing a first high pressure fluid jet on the stream of material at the first shredding station, thereby shredding first portions of the material, and removing said first portions from the stream of material, second portions of the stream of material continuing along the path;

directing a second high pressure fluid jet on the stream of material at the second shredding station and at a pressure higher than a pressure of said first fluid jet, thereby shredding said second portions of the material, and removing said second portions from the path.

4. The method defined in claim 3, wherein the stream of material contains at least one of metal, volatile liquid and flammable liquid.

5. The method defined by claim 3, wherein said conveying step includes carrying the stream of material on a substantially horizontally movable member having openings therein, and said collecting step includes receiving the first and second shredded portions of the material that fall through the openings at spaced points along the path.

6. A fluid jet shredder apparatus, comprising:

means for conveying along a path, a stream of material to be shredded, said means for conveying includes a substantially horizontally movable member for carrying the stream of material along the path, the movable member having openings formed therein;

a shredding station adjacent said means for conveying, said shredding station including a fluid jet cutting nozzle directing a high pressure jet of fluid onto said stream of material in a direction crossing the path, whereby portions of said material are separated from the stream of said material and removed to a location disposed outside the path; and means positioned at said shredding station and below said means for conveying, for receiving the separated portions of material, whereby the separated portions of material pass through said openings formed in said means for conveying.

7. The apparatus defined in claim 6, wherein said high pressure jet of fluid contains an abrasive material.

8. A fluid jet shredder apparatus, comprising:

means for conveying a stream of material, to be shredded, said means for conveying having openings formed therein;

a first shredding station adjacent said means for conveying, said first shredding station including a fluid jet cutting nozzle directing a first high pressure jet of fluid onto said stream of material; and a second shredding station adjacent said means for conveying and sequentially spaced from said first shredding station, said second shredding station including a fluid jet cutting nozzle directing a second high pressure jet of fluid onto said stream of material subsequent to said fist high pressure jet, said second jet being at a pressure higher than said first jet, whereby first portions of said material are first separated from the stream of said material by said first jet and the separated first portions of material pass through said openings formed in the means for conveying, and second portions of said material are separated from the stream of said material by said second jet, subsequent to said first portions being separated by said first jet, and the separated second portions of material pass through said openings formed in the means for conveying.

9. The apparatus defined in claim 8, including:

first means positioned at said first shredding station and below said means for conveying, for receiving the first portions of material; and second means positioned at said second shredding station and below said means for conveying, for receiving the second portions of material.

10. The apparatus defined in claim 8, wherein said second high pressure jet of fluid contains abrasive material.

11. The apparatus defined in claim 8, wherein said first and second high pressure jets of fluid each contain abrasive material.

12. A fluid jet shredder apparatus, comprising:

means for conveying a stream of material to be shredded, said means of conveying having openings formed therein;

a plurality of shredding stations sequentially positioned adjacent said means for conveying, each of said shredding stations including a fluid jet cutting nozzle directing a high pressure jet of fluid onto said stream of material, each nozzle sequentially providing a higher pressure jet than an adjacent preceding nozzle, whereby portions of said material are sequentially separated from said stream of material with respect to hardness of the portions in relationship to the pressure of particular ones of the jets.

13. The apparatus as defined in claim 12, including:

means positioned at each shredding station and below said means for conveying, for receiving the portions of material separated from the stream.

14. The apparatus as defined in claim 12, wherein said high pressure jets of fluid selectively contain an abrasive material.

* * * * *